United States Patent [19]

Holdsworth

[11] 4,003,226

[45] Jan. 18, 1977

[54] AIR BLAST DUST REMOVING MACHINE

[75] Inventor: Eric Holdsworth, Bramley, Leeds, England

[73] Assignee: USM Corporation, Beverly, Mass.

[22] Filed: Apr. 7, 1976

[21] Appl. No.: 674,300

[30] Foreign Application Priority Data

Apr. 8, 1975 United Kingdom ..... 14254/75

[52] U.S. Cl. ..... 69/1; 15/303

[51] Int. Cl.[2] ..... C14B 1/00

[58] Field of Search ..... 69/1; 15/300 R, 301, 15/303, 306 R, 306 B, 316 B

[56] References Cited

UNITED STATES PATENTS

| | | | |
|---|---|---|---|
| 2,466,477 | 4/1949 | Rhodes | 69/1 X |
| 2,482,775 | 9/1949 | Hollick | 69/1 X |
| 2,482,781 | 9/1949 | Knowlton et al. | 69/1 |
| 2,515,223 | 7/1950 | Hollick | 69/1 |
| 2,551,598 | 5/1951 | Hall | 69/1 |

*Primary Examiner*—Alfred R. Guest
*Attorney, Agent, or Firm*—Donald N. Halgren; Richard B. Megley; Vincent A. White

[57] ABSTRACT

An air blast dust removal machine has a jet of air projected from at least one slot-like nozzle inclined at an obtuse angle towards an oncoming sheet material which is held to a moving permeable conveyor belt. The sheet material is held to the conveyor belt by at least one suction device desposed on the opposite side of the conveyor belt as the sheet material passes adjacent the jet of air. A second conveyor belt holds the sheet material from its top side by a suction device; and an obtusely projected jet of air blasts dust from the bottom side of the sheet material.

9 Claims, 1 Drawing Figure

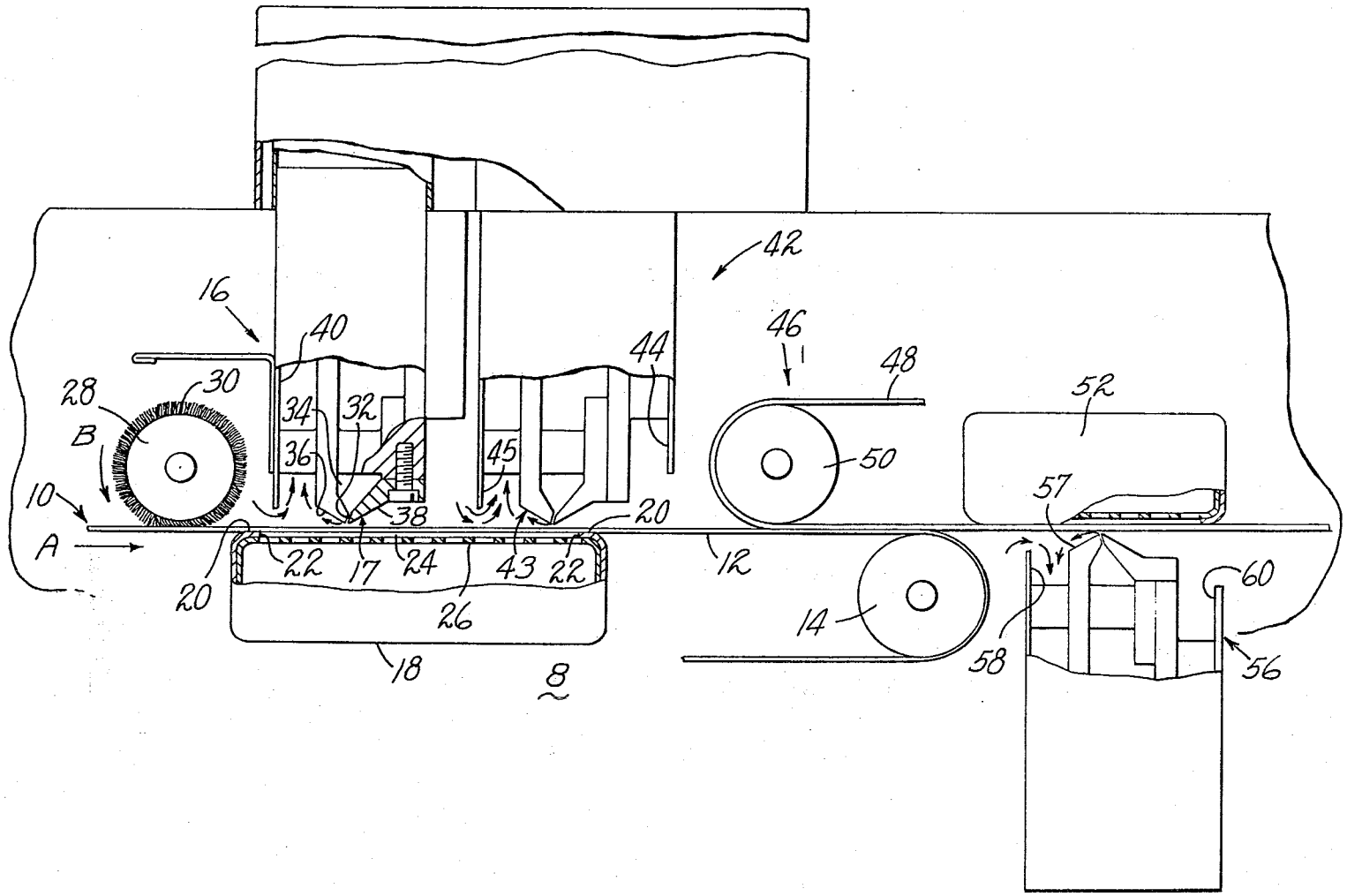
56
60
52
57
58
48
50
14
42
46
12
44
20
22
8
43
45
26
24
38
18
32
17
40
34
36
22
16
30
20
28
B
10
A

AIR BLAST DUST REMOVING MACHINE

BACKGROUND OF THE INVENTION

1. Field of the Invention

This invention is concerned with dust removing machines, especially machines for removing dust from sheet materials, for example, leather.

2. Prior Art

At some stages in the manufacture of leather, a hide is subjected to operations which generate a considerable quantity of leather dust, much of which remains on the hide. The presence of dust on the leather is undesirable in subsequent leather manufacturing operations.

One of the objects of the present invention is to provide an improved machine for removing dust from sheet material.

Prior art, for example U.S. Pat. Nos. 2,515,223; 2,482,781; and 2,482,775, have proposed to remove dust from sheet material, namely hides, by a method in which the hide is moved on a travelling conveyor past a nozzle device and a suction device on the same side of the conveyor as the nozzle. The nozzle device directs a stream of air at low pressure on to the hide. The nozzle device is long enough to extend completely across the hide, and the suction device is arranged to draw away dust-laiden air from the moving hide in the vicinity of the nozzle device.

It has now been found that dust removal is more effective, if the jets are inclined at an obtuse angle with respect to work preceding the nozzle device, that is the work from which dust has not yet been removed by operation of the jet.

Another object of the present invention is to provide a machine by which dust can be removed from flimsy sheet materials.

SUMMARY OF THE INVENTION

The present invention provides a machine suitable for use in removing dust from sheet material, namely hides, said machine comprising a first and a second belt conveyor for supporting the sheet material in flat, or substantially flat, condition with a surface to be cleaned exposed, and for moving the sheet material through the machine. The machine further comprises three nozzle devices: first and second nozzle devices for projecting jets of air against the exposed surface of sheet material supported by the first conveyor and a third nozzle device for projecting a jet of air against the exposed surface of sheet material supported by the second conveyor. The surface exposed when the material is supported by the second conveyor being the opposite surface to that exposed when the material is supported by the first conveyor.

Associated with each of the nozzle devices is a suction device, disposed adjacent and immediately preceding the associated nozzle device, and at the same side of the conveyor as the nozzle device, so that material from which dust is to be removed passes the suction device before passing the associated nozzle device.

The machine further includes suction holddown means comprising a first suction box disposed opposite the first and second nozzle devices with the conveyor belt of the first conveyor passing between the first suction box, and the first and second nozzle devices. A second suction box is disposed opposite the third nozzle device with the conveyor belt of the second conveyor disposed between the third nozzle device and the second suction box. The suction boxes of the machine are disposed to apply suction through the belt (which is air-permeable) to retain work, viz. sheet material from which dust is to be removed, in position on the belt as the work is carried by the belt through the machine passed the nozzle devices.

The jet of air projected from each of the nozzle devices is inclined at an angle of between 100° and 110°, preferably about 107°, with the exposed surface of sheet material supported by the associated conveyor, the angle being measured relative to material in front of the nozzle device: that is, relative to that material which has not yet been operated on by the nozzle device.

BRIEF DESCRIPTION OF THE DRAWING

The accompanying drawing is a diagrammatic view, partly in section and with parts broken away, of the illustrative dust removing machine.

DESCRIPTION OF THE PREFERRED EMBODIMENT

Referring to the drawing in detail, the invention shown therein is a dust removing machine 8 comprising a first feed conveyor 10, including a first conveyor belt 12 which passes round a pair of parallel, horizontal rollers 14 (only one shown in the drawing) disposed one at either end of the machine 8. One of the rollers 14 is arranged to be driven at a suitable speed by a motor (not shown) to drive the conveyor belt at a constant speed, generally between 100 and 200 feet per minute preferably about 180 feet per minute, in the direction of the arrow A. The conveyor belt 12 is held with the upper run thereof in tension so that an uppermost surface of the conveyor belt is at least substantially planar. The conveyor belt is made of poromeric material, namely a microporous poromeric shoe upper material.

The dust removing machine 8 further comprises a dust removing means 16 disposed above the upper run of the conveyor belt 12. The dust removing means 16 extends transversely of the conveyor belt across its full width. A first suction box 18 is disposed between the upper and lower runs of the conveyor belt 12 opposite the dust removing means 16, and extends across the full width of the conveyor belt 12. The upper run of the conveyor belt 12 is slidingly supported by a pair of support surfaces 20 of the suction box 18. A recess 24 extends across the conveyor belt 12, between a left and a right edge portion 22 of the surfaces 20, the conveyor belt 12 being so disposed as to close the top of the recess 24. The bottom of the recess is defined by a perforated plate 26.

The dust removing means 16 comprises a spreading roll 28 having a surface portion provided with bristles 30. The spreading roll 28 extends across the full width of the conveyor belt 12 and rotates in the direction of the arrow B on the drawing.

The dust removing means 16 further comprises a first nozzle device 17 having a slot 32 extending transversely of the direction of movement of the conveyor belt, substantially at right angles to the direction of movement and extending across the full width of the belt. The slot 32 is formed by two opposing, parallel walls spaced between 0.10 and 0.15 mm apart (depending upon the application for which the dust removing machine is intended) and each about 4.2 mm in depth. The slot 32 leads from a chamber 34 of generally triangular cross-section also extending transversely to the conveyor belt 12. The chamber 34 has a horizontal top face (parallel with the upper run of the conveyor belt 12), and approximately vertical front face, and an inclined rear face, inclined at an angle of about 50° to the horizontal top face. The slot 32 leads from the bottom apex of the chamber. The parallel walls of the slot 32 are inclined at an angle of about 17° to the vertical and the lowermost portion of the slot 32 is forwardly of the upper portion where the slot leads from the chamber 34.

The slot 32 opens at an apex between a pair of flat surfaces, 36 and 38, of the first nozzle device 17. The surfaces terminate at an edge defining an outlet end of the slot 32, the surfaces extending across the width of the conveyor belt 12. The front surface 36 is inclined upwardly from the edge defining the outlet end of the slot 32 at an angle of 30° to the horizontal, and the rear surface 38 is inclined upwardly from the edge defining the outlet end of the slot 32 at an angle 30° to the horizontal. The lowermost portions (viz, the edges) of the surfaces 36,38 are spaced approximately 3 mm from the upper surface of the upper run of the conveyor belt 12.

In front of the slot 32, between the slot 32 and the spreading roll 28, is a suction device comprising an exhaust duct 40. The exhaust duct 40 extends across the full width of the conveyor belt 12. The inclined front surface 36 of the nozzle device 17 leads upwardly towards the duct 40. A front edge portion of the duct 40 is spaced about 1 centimeter above the upper surface of the upper run of the conveyor belt 12.

A second dust removing means 42 comprising a second nozzle device 43 and an associated suction device comprising an exhaust duct 45 of construction and arrangement identical with the first nozzle device 17 and its associated suction device of the first dust removing means 16 is positioned immediately following the first removing means. A front edge portion of the suction box 18 is disposed just rearwardly of the spreading roll and extends rearwardly past the slot 32 of the first nozzle device and the slot of the second nozzle device 43, terminating just rearwardly of the slot of the second dust removing means 42.

To the rear of the second dust removing means a rear exhaust duct 44 is disposed to collect and carry away any duct disturbed by the nozzle devices 17,43 leaking rearwardly therefrom.

A second feed conveyor 46, disposed rearwardly of exhaust duct 44, is comprised of a second conveyor belt 48 extending round rollers 50 (only one visible in the drawings), a lower run of the conveyor belt 48 being kept in tensioned condition and being disposed horizontally, the lower run of the conveyor belt 48 overlapping the upper run of the conveyor belt 12 and being spaced slightly therefrom.

An upper suction box 52 (of generally similar construction to the suction box 18, but with the perforated plate thereof directed downwardly forming a lower wall of the box 52) is disposed above the lower run of the conveyor belt 48, with the lower run of the conveyor belt 48 in sliding contact with the suction box 52 spaced slightly from the perforated plate 54 thereof. A front edge of the suction box 52 overlaps with a rearmost portion of the feed conveyor 10 and extends rearwardly. A third dust removing means 56 is disposed beyond the rearmost portion of the feed conveyor 10. The third dust removing means 56 is generally similar to the first and second dust removing means 16,42 comprising a third nozzle device 57 and associated suction device, except that it is disposed beneath the lower run of the second feed conveyor 46 with the slot of the nozzle device 57 directed generally upwardly. The suction box 52 extends just rearwardly of the slot of the third nozzle device 57. The suction device of the third dust removing means comprises a front exhaust duct 58 (corresponding with the exhaust duct 40 of the first duct removing means) and the third dust removing means comprises a rear exhaust duct 60 corresponding to the duct 44.

In the operation of the duct removing machine 8 sheet material, viz. a hide, from which the dust is to be removed, is laid on the upper surface of the conveyor belt 12 in front of the spreading roll 28. The belt is driven as hereinbefore mentioned so that the upper run of the belt 12 travels in the direction of the arrow A, at a speed of about 180 feet per minute, carrying the hide towards the dust removing means. As the hide is carried beneath the spreading roll 28, the roll acts to spread the hide out and ensure that it lays flat on the upper surface of the upper run of the conveyor belt 12.

Air is removed from the suction box 18, preferably at a rate of about 900 cubic feet free air per minute, during the operation of the machine 8, giving a suction through the conveyor belt 12 above the suction box 18, a water gauge static head of about 2″. As the hide is carried on the upper surface of the upper run of the conveyor belt 12 over the suction box 18, the hide is held on to the belt 12 by suction acting through the perforated plate 26 and the material of the conveyor belt. The material of the conveyor belt is such that air is not drawn through the pores in the belt very readily and thus a hide which does not extend over the full width of the suction box does not significantly affect the holding power: were the pores in the conveyor belt to be larger and permit a ready flow of air therethrough, presence of a hide extending over part only of the suction box 18 would merely cause air to be drawn through the uncovered holes in the conveyor belt and very little holding power would be exerted on the hide, or to obtain adequate holding power an enormous volume of air would need to be drawn through the suction box. The material of the belt is such that with a water gauge static head of about 2″ at the supporting surface of the belt, the flow of air through the belt is about 2.8 cubic feet free air/square inch/minute.

The hide held on to the belt 12 by the suction applied through the suction box 18 is carried by the belt past the slot 32. Air is forced through the slot 32 at a rate of about 100 cubic feet per minute and leaves the slot in a directional jet angled at about 17° to the vertical, that is at an angle to the planar upper surface of the hide, of about 107° with respect to the hide surface in front of the nozzle from which dust has not yet been removed. It is important that the depth of the slot should be about 4 mm for a slot 0.10 mm in width to ensure that the jet of air issuing from the slot is sufficiently non-divergent. The jet of air projected from the slot 32 impinges on the planar upper surface of the sheet material carried by the conveyor belt 12 and, because of the angle at which the jet is inclined, blows any loose particles of dust or other material from the surface of the hide, forwardly. It is important that the surfaces 36,38 bounding the slot 32, especially the front surface 36 of the first nozzle device 17, be inclined upwardly from the slot 32 at a sufficient angle; if the angle of inclination of the surface 36 is too low, the jet of air issuing from the slot 32 tends to adhere to the surface 36, (the "Bernoulli" effect) and the jet which actually impinges on to the surface of sheet material carried by the conveyor belt 12 will have insufficient power to remove the dust therefrom and moreover aerodynamic lift may be actually generated, tending to lift the sheet material from the conveyor, opposing the suction of the suction box. By angling the surfaces 36,38, the jet remains sufficiently directional and these possible deficiencies are avoided.

In the operation of the machine 8, the front exhaust duct 40 is subject to suction of about 570 cubic feet per minute of air being drawn through the duct. The dust carried forwardly by the air issuing from the slot 32 is drawn into the duct 40 and carried away to a dust separating unit of known design (not shown) in which the dust is separated from the air. Air is also drawn into the duct 40 from between the duct 40 and the spreading roll 28, flowing beneath the lower edge portion of the front wall of the duct 40; this stream of air entering the duct 40 militates against any dust blown from the hide by the jet of air issuing from the slot 32 escaping from the apparatus forwardly from beneath the nozzle device 17 and contaminating the surrounding atmosphere.

Any air leaking rearwardly from the slot 32 carrying with it a small amount of dust is drawn into the exhaust duct 45 of the suction devices of the second dust removing means 42. The suction applied by the suction box 18 is sufficient to hold the hide firmly on to the conveyor belt 12 even though a leading edge portion of the hide is subjected to a lifting action when it first passes the jet of air issuing from the slot 32, and the hide is also subjected to the suction exerted through the exhaust duct 40.

The hide is then carried on the conveyor belt 12 past the second dust removing means 42 where any dust remaining on the upper surface of the hide is removed by the second dust removing means similar to that of the first dust removing means 16. Any air carrying with it dust, escaping rearwardly from the slot of the nozzle device 43 of the second dust removing means 42 is drawn into the rear exhaust duct 44 through which about 350 cubic feet of air per minute is drawn, the rear exhaust duct 44 being wider than the front exhaust duct so that a lesser suction effect is exerted, thereby to avoid the hide being lifted from the conveyor belt (the suction box 18 is not extending rearwardly sufficiently to maintain the hide on the belt as it passes beneath the rear exhaust duct 44).

The hide is carried further rearwardly by the belt 12 underneath the lower run of the conveyor belt 48 of the second feed conveyor 46 so that the hide is sandwiched between both of the belts 12,48. In the operation of the machine 8, the hide, as it moves further rearwardly beyond the rearmost end portion of the feed conveyor 10, is retained on the lower surface of the lower run of the belt 48 by suction applied by the suction box 52. The amount of suction exerted by the suction box 52 is the same as that exerted by the suction box 18 in which about 450 cubic feet of air per minute are withdrawn through the suction box 52, giving a suction amounting to a water gauge static head of about 2″. The hide is carried on the lower run of the second belt 48 over the third dust removing means 56 and dust is blown from the lower surface of the hide by a jet of air issuing from the slot of the third dust removing means 56, the dust being removed through the front exhaust duct 58 of the third dust removing means 56. The operation of the third dust removing means 56 is thus similar to that of the first dust removing means 16. After the hide has passed over the slot of the nozzle device 57 of the third dust removing means and beyond the rearmost edge portion of the suction box 52 (the rearmost edge portion being disposed slightly rearwardly of the slot of the third nozzle device 57), the hide falls away from the conveyor belt 48 on to an inclined table and is removed by an operator.

The machine removes dust from both faces of a hide efficiently and is of simpler construction that known dust removing apparatus commonly used in the tanning industry.

The machine is effective on very thin and flimsy leathers for which known machines of the prior art have proved unsuitable because of the tendency of the flimsy leather to be disturbed by the air issuing from nozzle devices and become entangled in the known machines. Each of the suction boxes 18,52 firmly hold hides on the belts even though the whole of the suction box is not covered by the hide.

Although the machine comprises two upper nozzle devices, it has been found in practice that only one of the upper nozzle devices is necessary for most purposes. The efficiency of the illustrative machine is improved to such an extent over the prior art, that it is necessary to use only one of the upper nozzle devices to remove dust from certain types of leather for which the use of two upper nozzles in previous machines had been regarded as essential, with a consequent saving in power and expense.

Should the conveyor belts 12,48 of the illustrative machine become clogged by leather dust, the belts may be cleaned by blowing air under pressure through the suction boxes 18,52 to apply air under pressure to the belts and force the dust from the pores of the belt; alternatively the belts may be moved past suction boxes (similar to the boxes 18,52) positioned to operate on the same surface of the belt as the nozzle devices (that is the opposite surface to the boxes 18,52), say on the run of the belt which does not support work (that is the lower run of the first belt) whereby to withdraw the dust particles from the belt.

I claim:

1. A machine for removing dust from sheet material, said machine comprising:

a first conveyor having a belt for supporting the sheet material in generally flat condition and for moving the sheet material through said machine;

said belt being permeable to air;

a nozzle device for projecting at least one jet of air against an exposed surface of the sheet material supported by said conveyor belt as the sheet material is carried by said belt through said machine during operation thereof;

said jets being inclined at an obtuse angle to the oncoming exposed surface of the sheet material; and a suction hold-down means disposed opposite said nozzle device with said conveyor belt disposed between said nozzle device and said hold-down means;

said hold-down means applying suction through said permeable conveyor belt to hold the sheet material in contact with the conveyor belt.

2. A machine for removing dust from sheet material as recited in claim 1, wherein said nozzle device extends completely across said conveyor belt, and said jets are inclined at an angle of between 100° and 110° with the oncoming exposed surface of sheet material, said angle being relative to material which has yet to pass said nozzle device.

3. A machine for removing dust from sheet material as recited in claim 1, wherein said nozzle device for projecting at least one jet of air against the exposed surface of sheet material comprises a slot extending transversely of said conveyor belt, said jet of air being projected through said slot, said nozzle device being comprised of a forward first slot surface and a second rearward slot surface, one at either side of said slot, each of said surfaces terminating at an edge defining an outlet end of said slot, said surfaces being inclined so that said edges define the outlet end of said slot, said surfaces being inclined so that said edges defining the outlet end of said slot are the parts of said nozzle device nearest said conveyor belt.

4. A machine for removing dust from sheet material as recited in claim 3, wherein said suction hold-down means is disposed at a first side of said belt to apply suction through said belt to retain sheet material in position on the opposite side of said belt as the sheet material is carried by said belt through said machine, said belt being of such a permeability that with a suction water gauge static head, having a range of from about 1 inch to about 6 inches, preferably averaging about 2 inches at said opposite side of said belt, the flow of air through said belt is at least about 4 cubic feet free air per square inch per minute.

5. A machine for removing dust from sheet material as recited in claim 3, wherein said first surface, which defines the forward wall of said slot, is generally parallel with the second surface which defines the rearward wall of said slot; said first and second surfaces being inclined at about 17° with the vertical.

6. A machine for removing dust from sheet material as recited in claim 3, where said air-permeable conveyor belt is comprised of poromeric material.

7. A machine for removing dust from sheet material as recited in claim 3, wherein said sheet material comprises animal hides.

8. A machine for removing dust from sheet material as recited in claim 6, wherein said conveyor belt passes the sheet material from its upper run to a second conveyor on its lower run; said sheet material being held to said second conveyor belt as it was held to the first conveyor belt; said second conveyor belt permitting the conveyor belt side of the sheet material from the first conveyor belt to be jetted with air for the removal of dust as was done with the initial dust removal on the first conveyor belt.

9. A machine for removing dust from sheet material as recited in claim 8, wherein said second conveyor belt has a lower run which overlaps the upper run of said first conveyor belt.

* * * * *

UNITED STATES PATENT OFFICE

CERTIFICATE OF CORRECTION

Patent No. 4,003,226 Dated January 18, 1977

Inventor(s) Eric Holdsworth

It is certified that error appears in the above-identified patent and that said Letters Patent are hereby corrected as shown below:

Column 8, line 19, before "on" should read -- belt --.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*